United States Patent [19]

Boyer

[11] 4,042,035

[45] Aug. 16, 1977

[54] APPARATUS FOR REMOVING, CLEANING AND REPLACING RAILROAD BALLAST

[75] Inventor: Jean Jacques Boyer, Montchauvet, France

[73] Assignee: Societe Anonyme Secmafer, Buchelay, Mantes, France

[21] Appl. No.: 702,119

[22] Filed: July 2, 1976

[30] Foreign Application Priority Data

July 2, 1975 France ..... 75.20742

[51] Int. Cl.[2] ..... E01B 27/08

[52] U.S. Cl. ..... 171/16

[58] Field of Search ..... 171/16; 37/104; 104/2, 104/7 R, 7 A, 7 B, 1 R

[56] References Cited

FOREIGN PATENT DOCUMENTS 2,127,507 1/1973 Germany ..... 171/16

*Primary Examiner*—Jay N. Eskovitz

*Attorney, Agent, or Firm*—Young & Thompson

[57] ABSTRACT

A device for removing, cleaning and replacing railroad ballast on a railway road bed comprises a chassis mounted on endless treads, the chassis carrying a bucket elevator at its forward end, that scoops up the ballast and discharges it onto a device that cleans the ballast by removing oversized and undersized particles and dirt. The cleaned pebbles of the ballast then fall to a conveyor belt which moves forwardly to deposit them again on the railway road bed in advance of the treads. The bucket elevator is mounted for horizontal swinging movement about a fixed vertical axis on the chassis; and the conveyor belt is similarly mounted; but the vertical axis of the conveyor belt is in advance of that of the bucket elevator, and the forward end of the conveyor belt is pivotally interconnected about a vertical axis with the bucket elevator for horizontal swinging movement with and relative to the bucket elevator. In this way, the cleaned ballast is evenly distributed over the area swept by the bucket elevator.

5 Claims, 4 Drawing Figures

APPARATUS FOR REMOVING, CLEANING AND REPLACING RAILROAD BALLAST

Apparatus used for the repair and reconstruction of railroad beds are machines which take up the old ballast, screen it and replace on the road bed the ballast pebbles which have been cleaned of oversized and undersized particles and of dirt. The replaced pebbles are levelled and tamped to the desired grade, the screened-out residue being discharged to a container vehicle or to the side of the road bed.

In French Patent No. 1,526,948, there is disclosed such a device that is useful in connection with running track, that is, track apart from stations and switches. Such a device raises the rails themselves and runs along them in such a manner that the bucket chain elevator passes under the rails, the ballast being redeposited behind the bucket elevator and spread out before the rails are lowered back onto it. Such a machine is supported on the rails themselves, but at points in front of and behind the operation of ballast removal, cleaning and replacement.

But such a machine is not usable in the vicinity of switches, and more generally in vicinities such as stations where the working space is limited. It is in those instances necessary to handle the track and the ballast manually. It has been attempted to use bucket cleaners of known types, that is, mounted on endless tracks and comprising in advance a bucket elevator mounted for horizontal swinging movement about a vertical axis so as to sweep the desired width. These bucket elevators can discharge the removed material laterally or into transport vehicles. They can also clean the ballast and replace the reusable portion of the ballast, but, in such cases, the ballast is generally replaced behind the machine, that is, behind the endless treads. A number of disadvantages arise from this.

The first disadvantage comprises the fact that the machine must ride on the road bed from which the ballast has been removed, which is a relatively loose and movable surface. The tracks can dig irregularly into the road bed, particularly because the bucket conveyor sweeps right and left and the chassis accordingly has various inclinations. Moreover, it is then difficult to level the ballast that has been replaced on the road bed.

It has been proposed in certain machines of this type to redeposit the ballast in front of the treads but behind the bucket conveyor; but the suggested means for again spreading out and grading the ballast have ordinarily comprised a fixed transverse blade which has not operated well in practice. It has accordingly been seen to be desirable to spread the ballast over the entire width of the road bed at the very moment of its redeposition.

The present invention overcomes these difficulties of the prior art, by providing such a device comprising a chassis mounted on endless treads and carrying at its forward end a bucket elevator or conveyor mounted for horizontal swinging movement about a vertical axis and, carried by the chassis, a separating and grading arrangement for eliminating oversized and undersized particles and dirt, and for rejecting this removed material, thereafter to redeposit and spread on the road bed the cleaned ballast behind the bucket elevator but in front of the treads. The spreading apparatus carried by the machine which acts thus on the ballast is mounted in front of the treads and is characterized by a belt conveyor which deposits the cleaned ballast behind the bucket conveyor and which is mounted for rotation at its rear end about a vertical axis fixed with respect to the chassis, this axis being disposed in front of the vertical axis of horizontal swinging movement of the bucket conveyor. The belt conveyor is interconnected to the bucket conveyor at a point forwardly of its axis of horizontal swinging movement, about a third vertical axis of relative horizontal swinging movement, so that upon horizontal swinging of the bucket conveyor, the forward end of the belt conveyor also swings horizontally. The cleaned ballast is discharged from the forward end of the belt conveyor, so that the ballast is deposited over substantially the entire width of the zone swept by the bucket conveyor.

According to another characteristic of the present invention, grading is effected by blades suspended from the belt conveyor frame, the lower edge of these blades being at an elevation relative to the treads corresponding to the level to which the ballast is compacted by the treads.

According to still another characteristic of the present invention, these blades are mounted on the belt conveyor frame in such a manner as to ride up out of operative position, upon horizontal swinging movement of the belt conveyor, when the blades are travelling behind the belt conveyor, only the forward blade being then in the lowered or active position. This arrangement ensures that the excess ballast will be pushed to one side and the other of the surface that supports the railroad ties on the road bed.

These and other features of the invention will become apparent from a consideration of the following description, taken in connection with the accompanying drawings, in which.

Figure 1:
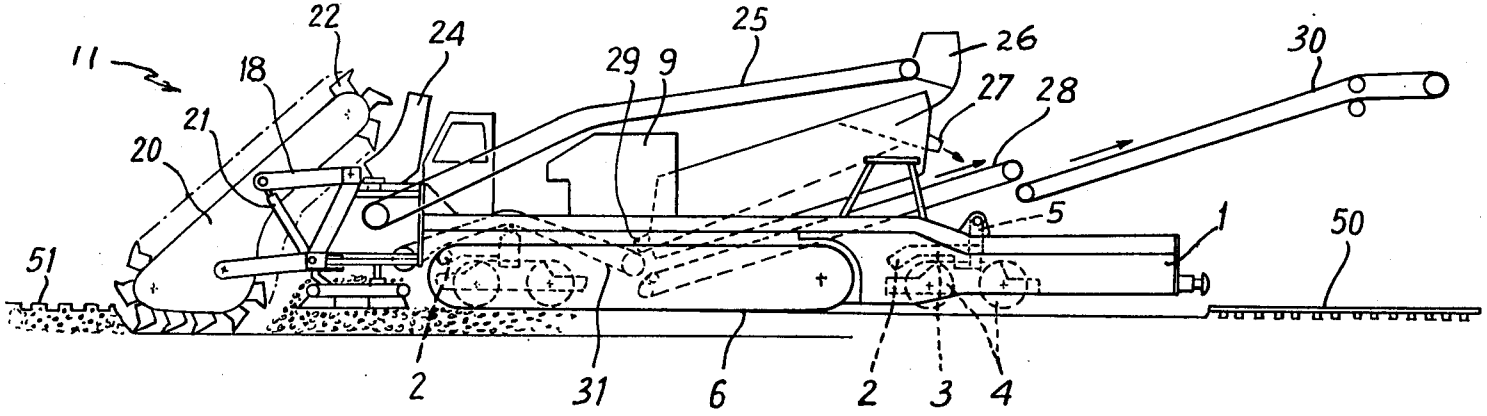
FIG. 1 is a side elevational view of apparatus according to the present invention.

Referring now to the drawings in greater detail, it will be seen that the apparatus according to the present invention comprises a chassis 1 on which are articulated at 2 the frames 3 which carry bogies 4 which may, be means of jacks 5, be raised to the position shown in the drawings, or which may be lowered so that the device may move as a railroad vehicle. But when the bogies 4 are raised, the device rests on endless tracks 6 which circulate on wheels 7 and are driven by sprockets 8 from the common motor 9, in known fashion.

At the forward end of the chassis 1 is mounted, on a vertical plate 10, a bucket conveyor indicated generally at 11, for horizontal swinging movement about a vertical axis 12. To this end, plate 10 has two semi-circular horizontal rails 13 and 14 coaxial with 12; and on each of these rails a pair of rollers 15 and 16 ride which carry the support frame 17 of the bucket conveyor, this frame being thus mounted for horizontal movement about a center coincident with axis 12 and being driven in either direction about this center by chains (not shown) that slide on rails 13 and 14 or in other known manner. On the frame 17 are articulated arms 18, which at their other end are pivotally connected at 19 to the frame 20 of the bucket elevator. These arms 18 form, with the support frame 17 and the frame of the bucket elevator, two lateral parallelograms with which jacks 21 coact to raise or lower the working level of the bucket elevator relative to chassis 1 of the device. Buckets 22 are disposed in an endless chain to circulate in a known manner on rollers 23 and are driven by a conventional drive shaft (not shown).

The bucket elevator empties the ballast and dirt into a screen 24 which separates them onto a conveyor belt 25 which raises them up to a grader 26. Grader 26 separates in a known fashion the oversized pieces which leave for example at 27 and the dirt and fines which fall on a conveyor belt 28, from the cleaned ballast which leaves the grader at 29. A conveyor belt 30 discharges the oversized pieces, dirt and fines and dumps them either into a vehicle or to the side of the road bed. This system of conveyors and separators and cleaners thus far described is conventional. To it may be added, if desired, means for adding new ballast or for discharging excess ballast.

The cleaned ballast discharged at 29 is received by a conveyor belt 31 which transports it, according to the invention, forwardly of the treads 6 onto a spreader conveyor 32 having a frame 33 which is supported at its rear end by a fixed axle 34 which is fixedly secured to a crosspiece 35 carried by rail 13. Vertical axle 34 is located in advance of vertical axis 12 described above. Frame 33 is also suspended at its forward end by an axle 36 carried by a lower horizontal crosspiece 37 of the support frame 17 of the bucket elevator. Axle 36 carries a U-shaped crosspiece 38 which carries at its lower ends rollers 39 which engage under flanges 40 of frame 33 of conveyor 32. This arrangement ensures a compensation of the variation of distance between the axles 34 and 36, which results from the change in orientation of the bucket conveyor and the belt conveyor 32 relative to each other, which will be described hereinafter.

Figure 2:
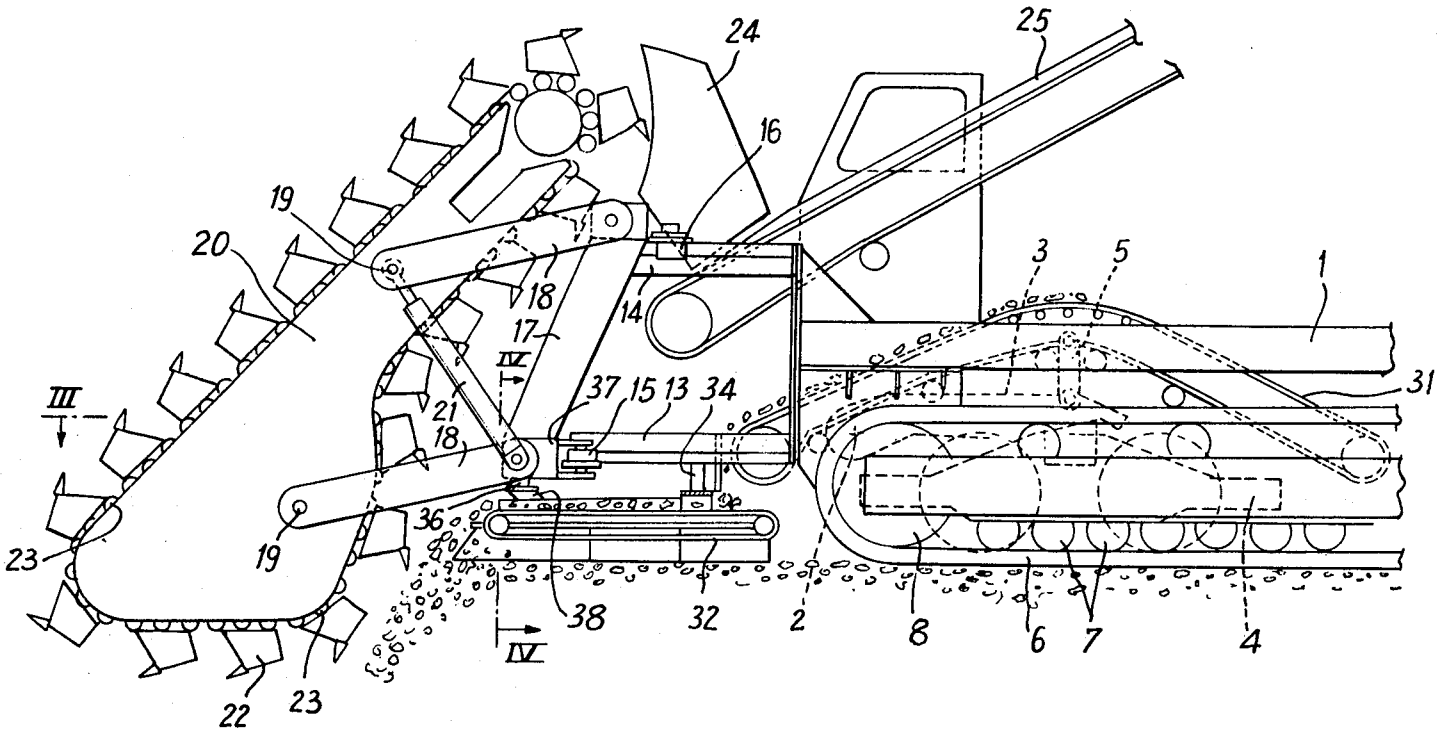
FIG. 2 is an enlarged view of the forward portion of the apparatus as seen in FIG. 1.
Figure 4:
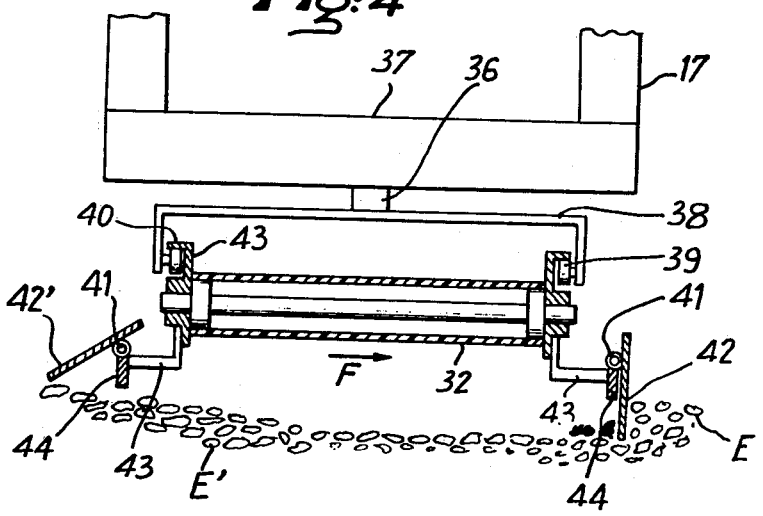
FIG. 4 is a fragmentary cross sectional view taken on the line 4—4 of FIG. 3 and showing the conveyor belt for cleaned ballast and the regulating blades.

Frame 33 of conveyor 32 carries, on the other hand, by laterally extending brackets 43 that are adjustable in height relative to frame 33, side plates 44 on the upper edges of which are mounted horizontal axles 41 on which are rotatably mounted the regulator blades 42, three in number on each side of the device in the illustrated example as seen in FIGS. 1 and 2. These blades can swing freely outwardly as shown at 42' in FIG. 4, but their inward swinging movement is limited to a vertical position by abutment of their lower portion against the plates 44.

Figure 3:
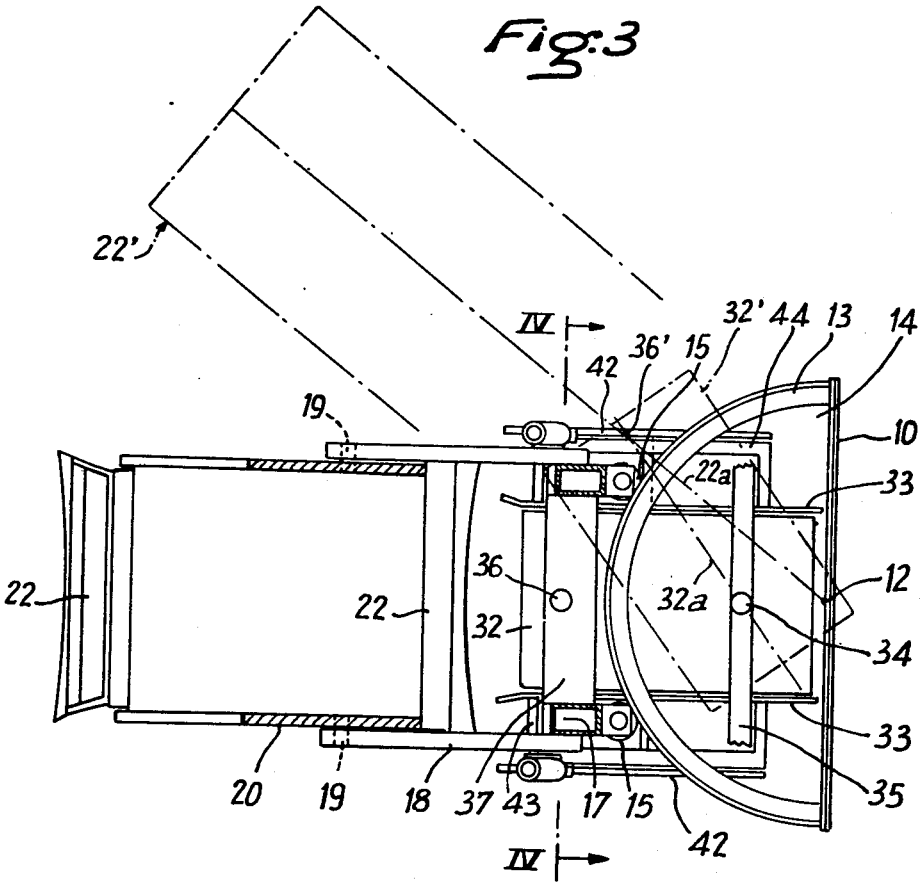
FIG. 3 is a somewhat schematic plan view of the bucket conveyor and belt for the cleaned ballast.

In operation, the device of the present invention moves on rails 50 toward the ballast 51 to be cleaned. The device is moved from rails 50 onto a portion of levelled ballast at the desired elevation. The device, supported now on the treads 6, is then advanced, the bucket conveyor swinging from right to left to collect and elevate the old ballast to the desired depth and over the desired width thereof. The ballast is cleaned and separated as described above and the clean ballast spread by the conveyor belt 32 into the trough cleared by the bucket conveyor. As seen in FIG. 3, from the position of the axles 34 and 36 relative to the axis 12 and because of the mounting of the axle 36 on the lower crosspiece of the bucket conveyor frame, when the bucket conveyor swings to the phantom line position shown in FIG. 3 at 22', the axle 36 moves to 36' and the conveyor belt 32 to 32', its vertical midplane **32*a* forming with the longitudinal axis of the overall device, a larger angle than that between the longitudinal midplane of the bucket conveyor and the longitudinal axis of the overall device. As a result, the conveyor belt 32, whose upper run travels forwardly as seen in FIG. 2,** discharges cleaned ballast into the trench formed by the bucket conveyor over a width which is greater than the width traversed by the treads, that is, over a width greater than the width of the ballasted road bed that supports the railroad ties.

The clean ballast is deposited immediately behind the bucket conveyor by the forward end of belt conveyor 32, to a depth greater than the final level of the ballast. Therefore, it is necessary to spread it to a depth greater by about 40 mm., than the depth to which it will be compacted by the treads, in order to provide for settling of the ballast. The spreading operation therefore must spread laterally the body of ballast deposited in the region swept by the conveyor belt 32. To this end, the regulator blades 42 are mounted as described above with reference to FIG. 4, the action of the blades being thus limited to a spreading action toward the outside, that is, in the direction F of oscillation of the frame 33 of the belt, the excess ballast being shown at E which is pushed to this position upon oscillatory movement of the forward blade 42, the blade 42' thus passing up over the ballast and having no effect to drag ballast back to the center of the road bed E'.

It is thus possible, by use of the present invention, to provide redeposited ballast on which the rails may be directly re-laid, at a desired height and level and compaction not only to support the re-laid rails, but also to support the device itself during its operation.

Although the present invention has been described and illustrated in connection with a preferred embodiment, it is to be understood that modifications and variations may be resorted to without departing from the spirit of the invention, as those skilled in this art will readilly understand. Such modifications and variations are considered to be within the purview and scope of the present invention as defined by the appended claims.

I claim:

1. Apparatus for removing, cleaning and redepositing railroad ballast, comprising a chassis mounted on endless treads, a bucket elevator mounted for horizontal swinging movement about a first vertical axis at the forward end of the chassis, means to receive and clean ballast from the bucket conveyor, and a conveyor belt whose upper run moves forwardly, for redepositing ballast from said cleaning means, means mounting said conveyor belt for horizontal swinging movement about a second vertical axis disposed adjacent the rear of the conveyor belt, the second axis being forward of the first axis, and means interconnecting a forward portion of the conveyor belt for horizontal swinging movement with and relative to said bucket conveyor about a third vertical axis.

2. Apparatus as claimed in claim 1, and blades depending from each side of said conveyor belt for levelling said ballast, the lower edges of said blades being disposed at about the level to which the ballast is compacted by said treads.

3. Apparatus as claimed in claim 2, and means mounting said blades for vertical swinging movement outwardly away from said conveyor belt but limiting inward swinging movement of said blades to an upright position, whereby ballast is moved only by the blade on the advancing side of the belt during horizontal swinging movement of the belt with the bucket elevator.

4. Apparatus as claimed in claim 1, said first and second axes being fixed relative to said chassis.

5. Apparatus as claimed in claim 1, said first and third axes lying on the longitudinal midplane of said bucket conveyor, said second and third axes lying on the longitudinal midplane of said belt conveyor.

* * * * *